United States Patent [19]

Williams, Sr. et al.

[11] 3,973,373

[45] Aug. 10, 1976

[54] AUTOMATIC PACKAGING METHOD AND APPARATUS

[75] Inventors: Winfried Wilbur Williams, Sr., Salisbury; David Clancy, Canaan, both of Conn.

[73] Assignee: Colgate-Palmolive Company, New York, N.Y.

[22] Filed: Mar. 10, 1975

[21] Appl. No.: 557,093

[52] U.S. Cl. ..... 53/120; 53/21 FW; 270/94

[51] Int. Cl.[2] ..... B65B 63/04

[58] Field of Search ..... 53/21 FW, 117, 120; 270/41, 61 F, 66, 83, 86, 94

[56] References Cited

UNITED STATES PATENTS 3,481,099 12/1969 Clancy ..... 53/120 X

*Primary Examiner*—Travis S. McGehee

*Attorney, Agent, or Firm*—Strauch, Nolan, Neale, Nies & Kurz

[57] ABSTRACT

Apparatus for automatically packaging folded towelettes wherein a flat web of sheet material is continuously fed from a roll or like supply vertically upwardly through a longitudinal folding device by feed rollers that grip the longitudinally folded web and move the leading end through a rotary knife station where the moving web is periodically severed to provide vertically disposed strips of predetermined length in succession in a first transverse fold station where a horizontally reciprocable blade engages and transversely folds each severed strip while thrusting it into a horizontal roller transport arrangement that feeds each transversely folded strip in turn to a second transverse fold station where a vertically reciprocable blade imparts the second transverse fold to the strip while thrusting it into an envelope.

20 Claims, 12 Drawing Figures

AUTOMATIC PACKAGING METHOD AND APPARATUS

This invention relates to methods and automatic apparatus for the packaging of folded towelettes or like sheets and particularly to correlated compact and efficient combinations of method steps and apparatus for continually forming, at the leading end of a continuous web of sheet material, longitudinally and transversely folded individual sheets in condition for packaging.

More specifically in its preferred embodiment the invention is concerned with the automatic sealed packaging of folded moist towelettes, usually rectangular sheets in the order of about five by eight inches when unfolded, and particularly in that phase wherein a flat web of dry absorbent sheet material is continuously drawn from a supply such as a large diameter roll with the leading end subjected to correlated folding and severing operations to continually produce individual folded towelettes and thrust them into individual packages that are then conventionally supplied with liquid for moistening the towelettes and sealed.

The invention provides as a major advantage novel methods and apparatus wherein the towelette material is subjected to an efficient sequence of successive linear angularly related movements terminating in individual folded towelettes being thrust into separate envelopes.

Another advantageous feature of invention is the provision of a novel method and apparatus whereby the leading end of a longitudinally folded web is moved substantially vertically upwardly through a web severing station directly into a first transverse fold station with a predetermined length being severed therefrom in timed relation with mechanism substantially directly and immediately imparting a transverse fold in the severed length. Pursuant to this advantage the invention provides novel mechanism for reciprocating a folding blade in timed relation with a rotary knife severing device.

Another advantage of the invention is the provision of a novel arrangement for receiving and conveying the severed towelette after it has been imparted a first transverse fold to a station where a second transverse fold is imparted while thrusting the folded towelette into an open envelope automatically positioned to receive it at the station.

A further advantage of the invention is to provide a novel compact mechanism in a machine for packaging folded towelettes whereby synchronously operated first and second transverse fold blades and a conveyor between them coact to impart sequential substantially linear fold and transfer movements to the towelette during folding.

A further advantage of the invention is the provision of a novel drive system in an automatic towelette packaging machine wherein cams on a common shaft with a rotary knife device for severing predetermined towelette lengths from the leading end of a continuous web are formed and connected to synchronously operate first and second reciprocable blades for imparting successive transverse folds to the severed towelette.

Further advantages will appear as the description proceeds in connection with the appended claims and the annexed drawings.

BACKGROUND OF INVENTION

Within applicant's knowledge the particular art to which the invention primarily pertains commercially originated essentially with machines and methods of the type disclosed in the patents to Clancy U.S. Pat. No. 3,481,099 and Weinberger U.S. Pat. No. 3,286,435. Each of these patents discloses machines for automatically packaging folded moist towelettes wherein the leading end of a web of absorbent towelette material is longitudinally folded, and then severed into towelette lengths which are transversly folded and thrust into envelopes automatically positioned in succession at a filling station. Clancy discloses imparting two transverse folds to the longitudinally folded towelette length prior to insertion into the envelope.

The present invention is directed mainly to methods and apparatus of the Clancy patent type, and particularly to the arrangements for handling the web and towelette and especially to methods and mechanism for dual transverse folding of the severed longitudinally folded towelette.

As evidenced by the later issued patents to Weinberger et al U.S. Pat. No. 3,747,200; Field U.S. Pat. No. 3,500,611 and Clancy U.S. Pat. No. 3,803,798 these machines have been sought to be continually improved. It will be noted that in dual transverse fold machines disclosed in these patents and at FIGS. 10–15 of Clancy U.S. Pat. No. 3,481,099 the longitudinally folded leading end of the towelette web is fed downwardly into the first fold station, thus requiring special guide arrangements above that station. In the invention as will appear the operations are performed with minimum movement of the web material, the longitudinally folded moving leading end of the web being directed upwardly immediately into the first transverse fold station, and the entire web handling arrangements are more compactly and accessibly arranged, which contributes to convenience in inspection of operation, cleaning and repairing, as will appear in the following specific disclosure of the preferred embodiment.

PREFERRED EMBODIMENTS

Figures 1, 1A:
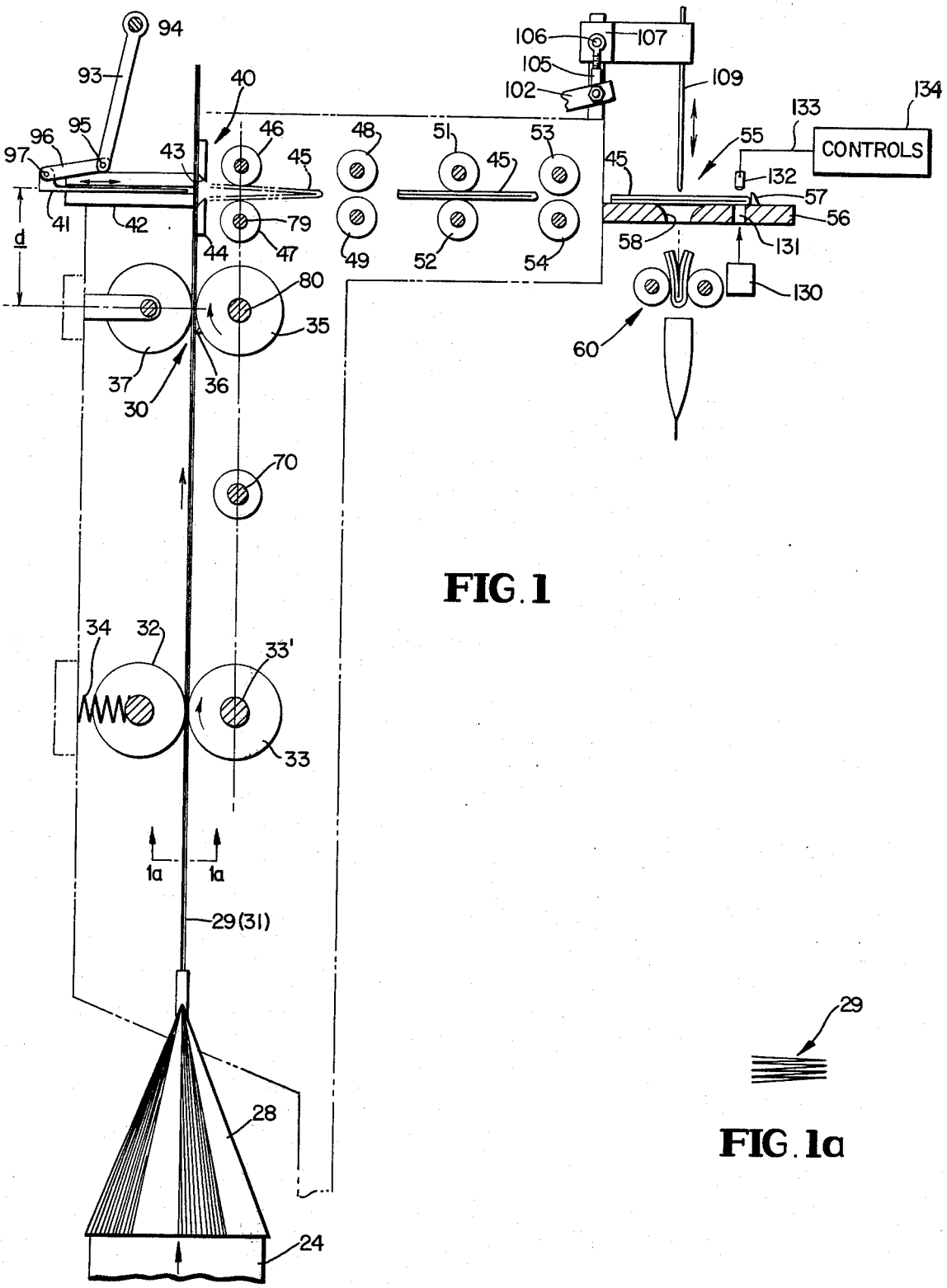
FIG. 1 is a side elevation, somewhat schematic and partly sectioned, illustrating the invention according to a preferred embodiment.
FIG. 1*a* diagrammatically shows the nature of the longitudinally folded tape section.
Figure 2:
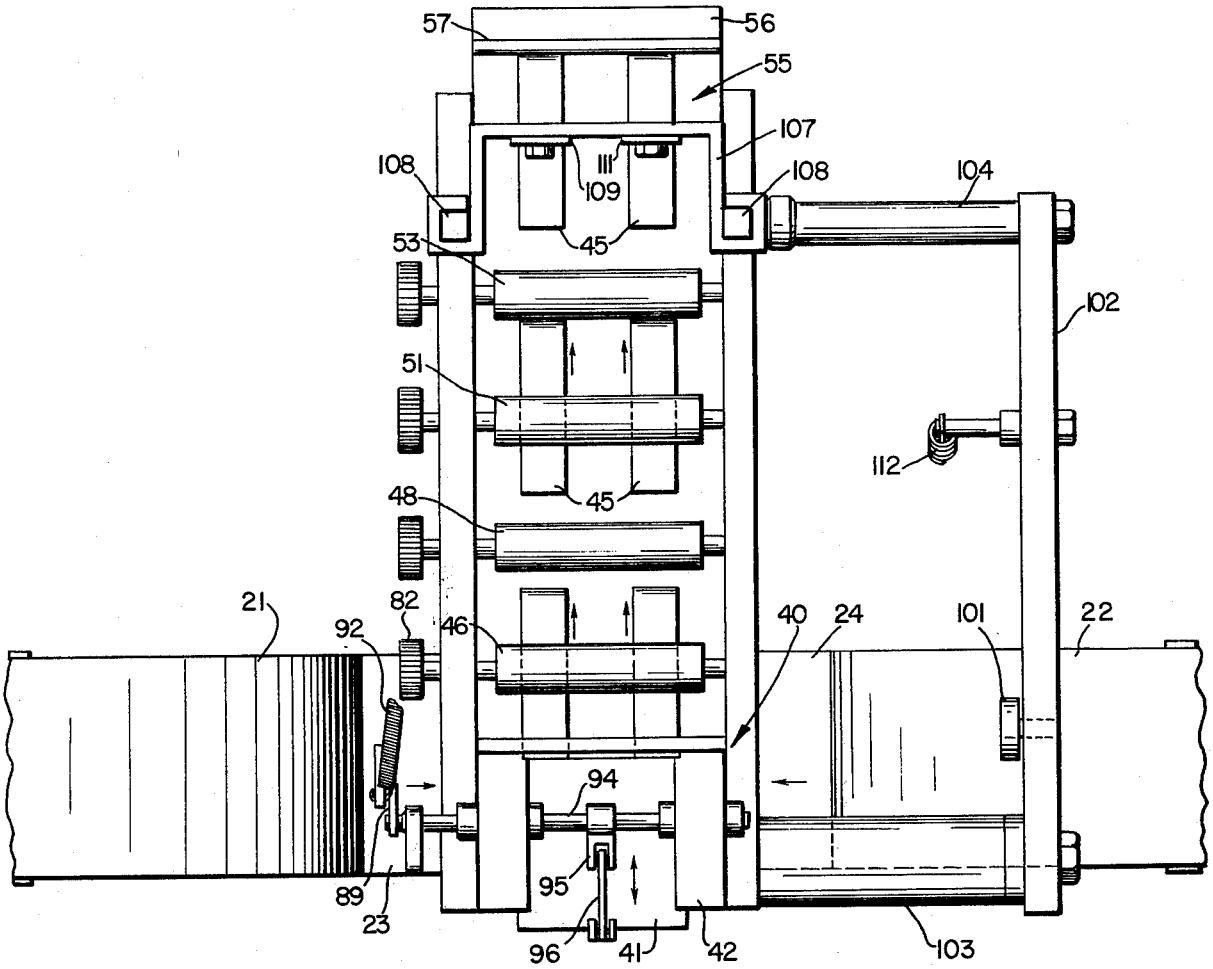
FIG. 2 is a fragmentary top plane view showing part of the apparatus of FIG. 1.
Figure 3:
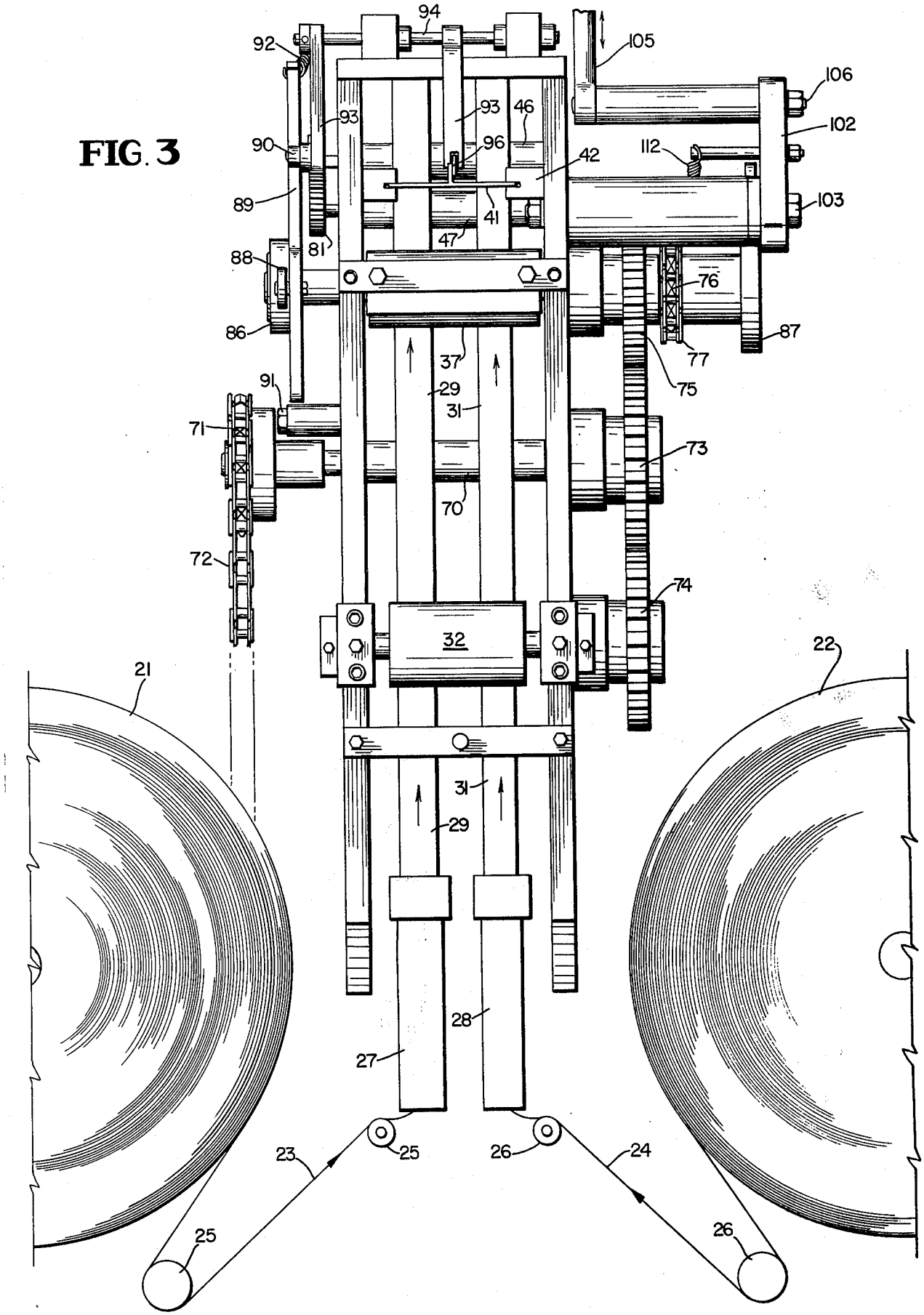
FIG. 3 is a front elevation further showing the apparatus of FIG. 1.

Referring to FIGS. 1–3, the illustrated apparatus is arranged to thrust folded towelettes into two side-by-side envelopes at the filling station, two towelette webs being fed into the machine and handled similarly side-by-side as will appear.

It will be understood that the invention is not limited to this particular embodiment, but is applicable to apparatus wherein any number of towelettes are thrust into the corresponding number of envelopes. For example the invention may be incoporated into single towelette apparatus such as disclosed in Clancy or Weinberger, or to apparatus wherein three or even more towelettes may be thrust at the same time into the corresponding number of side-by-side envelopes.

As shown in FIG. 3, two large diameter rotatable supply rollers 21 and 22 of absorbent paper provide webs 23 and 24 that pass over guides 25 and 26 respectively into separate longitudinal fold formers 27 and 28. The webs for packaging moist towelettes are for example each about five inches wide, and they pass into the formers substantially just above floor level. In the formers the webs are longitudinally folded and they emerge from the upper ends of the formers as relatively narrow folded flat tapes indicated at 29 and 31, which are parallel to each other and move side-by-side vertically upwardly in a substantially common plane perpendicular to the axes of rolls 21 and 22 in FIG. 3.

The longitudinal fold formers 27 and 28 may be conventional and they may be the formers disclosed in said Weinberger et al. U.S. Pat. No. 3,286,435 or in Benitez U.S. Pat. No. 3,361,425 to both of which reference is made for any further details necessary to understand the longitudinal folding operation.

FIG. 1 shows the apparatus as viewed looking from right to left in FIG. 3. The tapes 29 and 31 pass side-by-side between continuously rotating parallel feed rollers 32 and 33, with roller 33 being suitably driven as will appear and roller 32 biased as by spring 34 toward the driven roller to define a positive feed roll pass capable of accommodating to slight variations in tape thickness. At this point the web is longitudinally folded with an accordian type fold as shown in FIG. 1*a*. The surface of driven roller 33 is preferably knurled for more positive feed.

Above the feed roll pass, the tapes move side-by-side through a web severing station 30 having a rotary knife device comprising a continuously rotated roller 35 mounting a longitudinal knife blade 36 and an idly rotatable fixed axis roller anvil 37.

Above the rotary knife device, the tapes pass side-by-side directly into the first transverse fold station indicated at 40 in FIG. 1. At station 40 the leading ends of the tapes extend vertically in the path of a horizontally reciprocable first fold blade 41 that slides in a fixed guide 42 at right angles to the path of travel of the tapes to engage and impart the first transverse fold in the severed web strips.

In operation as will appear, the knife device severs a towelette length strip from the leading end of each tape and substantially immediately the blade 41 is moved to the right in FIG. 1 to engage the central region of each severed towelette strip to start folding and push each towelette strip during folding in side-by-side relation through a slotted horizontal aperture 43 in a fixed vertical guide 44, whereby each severed towelette strip is similarly transversely folded on itself and in that condition, as shown in FIG. 1 at 45, is pushed into a first transit roll pass consisting of upper and lower horizontal axis rollers 46 and 47.

Roll pass 46, 47 is the first of a series including transit roll passes 48, 49, 51, 52 and 53, 54 which convey the first transversely folded towelettes 45 side-by-side horizontally to the second transverse fold station indicated at 55. The foregoing transit roll passes define a horizontal path for the first folded towelette, and all of these transit rolls are preferably surface knurled and positively driven for assuring proper timed arrival of the first folded towelettes at the second fold station 55.

Figure 7:
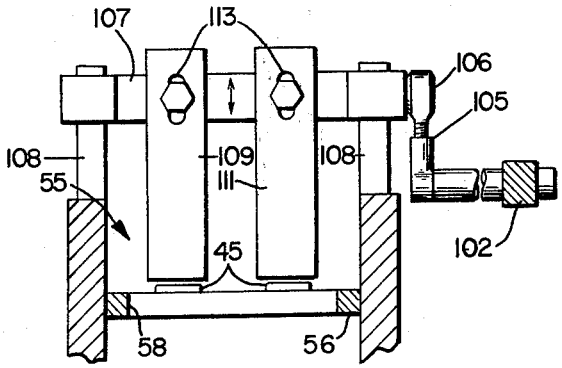
FIG. 7 is a fragmentary end view partly sectioned showing the vertically receiprocable second fold blades.

At the second transverse fold station, the two first transversely folded towelettes 45 which have been delivered side-by-side by the transport rollers onto the horizontal top surfaces of a fixed plate 56 and arrested by stop 57 in centered side-by-side position over plate opening 58 are individually simultaneously medially engaged by vertically descending blades 109 and 111 (FIG. 7) and thrust through aperture 58 whereby they are imparted a second transverse fold and downwardly inserted in final folded condition in side-by-side envelopes, substantially as indicated at 60 in FIG. 1.

As exaggeratedly shown in the drawing, the rollers of first transit roll pass 46, 47 are vertically spaced apart slightly more than the others, for the purposes of allowing a full stroke of blade 41 and avoiding binding of the blade 41 and damaging of the operating mechanism when the blade 41 first delivers the towelette strips into transit roll pass 46, 47.

The circumference of knife mounting roll 35 is preferably equal to the unit length of the tape strip section to be severed. In a practical embodiment where each folded tape 29, 31 is about 1¾ inches wide, the length of the strip to be severed for towelette purposes is about 7½ to 8 inches, and during each revolution of continuously rotating knife roller 35 one such length strip is severed from each tape.

By providing a fixed axis freely rotating roller anvil at 37, the severing action is cleaner and there is less wear on the knife blade 36.

Preferably the feed rollers 32 and 33 are of the same diameter and rotate at the same surface speed as knife roller 35 so that there is no slack between the feed and cutting stations. While the knife roller 35 preferably rotates only once to produce a single towelette, the rollers of the feed roller pass may turn any multiple of once per towelette strip unit length to produce the necessary tape speed.

The distance *d* between a horizontal plane containing the axes of rollers 35, 37 of the rotary knife station and the line of cut effected by the knife blade and the plane of reciprocation of blade 41 is equal to about half the unit towelette strip length, and the operation to the parts is so timed that knife blade 36 severs the tapes each time there is a towelette unit length (7½ to 8 inches) projecting above the horizontal plane through the knife roller axis, and substantially at the same time blade 41 is moved to the right to centrally engage the severed towelette strip and fold and thrust it into the takeaway transit roll pass 46, 47.

It has been found in practical operation that the upwardly extending longitudinally folded leading ends of the tapes above the rotary knife are substantially self-supporting, and that no upper end stop is needed although one may be provided if needed to arrest upward movement of the tape ends. Also by efficient correlated timing of blade 41 no special side support or guide 44 for the severed towelette strip is required and the blade 41 thrusts the towelette strip directly into the nip of rollers 46, 47.

The surface speeds of the horizontal series of rollers 46–54 must be large enough to help ensure that each first transversely folded towelette 45 is clear of the first fold station out of the path of the continuously upcoming ends of the tapes. Usually this is attained by rotating the rollers 46–54 at surface speeds a predetermined amount higher than that of knife roller 35, as for example about 10–20%.

While four sets of transit rollers are shown between the first and second transverse fold stations, fewer sets may be needed for shorter distances between the stations, and in one embodiment the takeaway pass rollers 46, 47 may deliver the folded towelette 45 directly to the second fold station 55. An advantage of having several sets of transport rollers is that they increasingly tighten the fold of the strip to provide towelette 45 in substantially optimum flat form at the second fold station.

Referring again to FIG. 1, it will be noted that all of the web, tape and towelette handling rolls are rotatable on parallel horizontal axes. A drive shaft 70 suitably journalled on the machine frame has at one end (FIG. 3) a sprocket 71 drive connected to a chain 72 driven from a motor or like source of power (not shown). At its opposite end shaft 70 carries a gear 73 meshed with gear 74 on the shaft 33' of feed roller 33 and gear 75 on the shaft 80 of knife 35. Thus, where rollers 33 and 35 of the same diameter and gears 74 and 75 of the same size, equal surface speeds in the same direction are provided for rollers 33 and 35.

Figure 11:
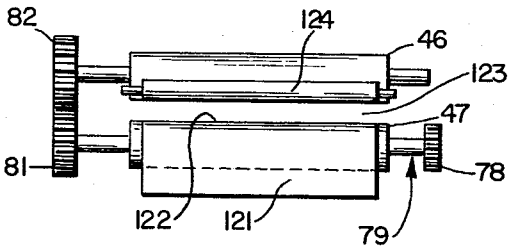
FIG. 11 is a front elevation showing fixed guide structure of FIG. 10 and the roller drive arrangements.

Shaft 80 of knife roller 35 is connected by a suitable drive system to continuously rotate the shaft 79 of lower takeaway transit roller 47. This drive system may be a direct gear train or it may be the sprocket and chain drive system shown in FIG. 9 and later described in more detail. At the opposite side of the transport, rollers 46 and 47 are drive connected by meshed gears 81 and 82 (FIG. 11). Suitable chains and/or gears connect rollers 46–54 to be all positively driven at the same surface speeds as will be described in later detail in connection with FIG. 9. In practice, shaft 79 (FIG. 4) comprises an inner section 83 non-rotatably mounting roller 47 and an outer section 85 fixed to sprocket 78, so that should blade 41 become entrapped between rolls 46 and 47 a shear limiting device 84 between the shaft sections will break the drive and stop the transport mechanism.

Figure 4:
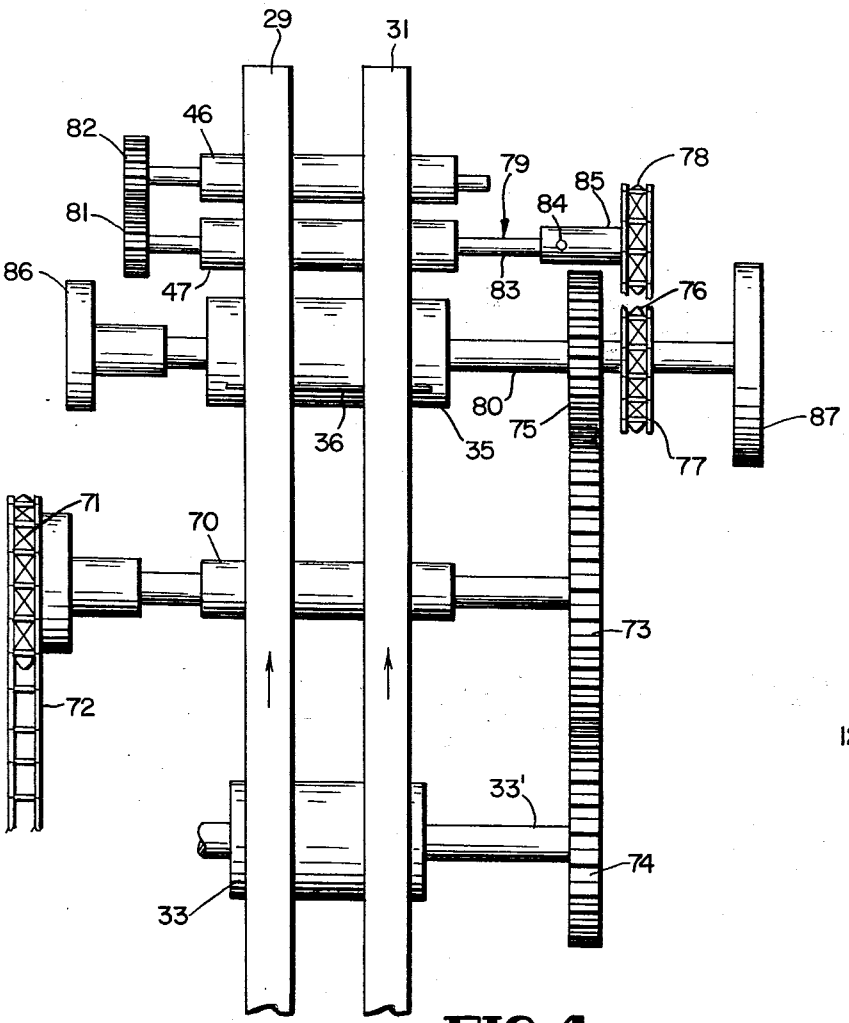
FIG. 4 is a fragmentary front elevation showing details of the drive arrangements.

As shown in FIG. 4, cams 86 and 87 are mounted on the opposite ends of the knife rotor shaft 80, and as showin in FIG. 1 the axes of feed roller 33, drive shaft 70, rotor shaft 80 and transit rollers 46 and 47 lie in a common vertical plane parallel to the direction of movement of the longitudinally folded webs.

Figure 5:
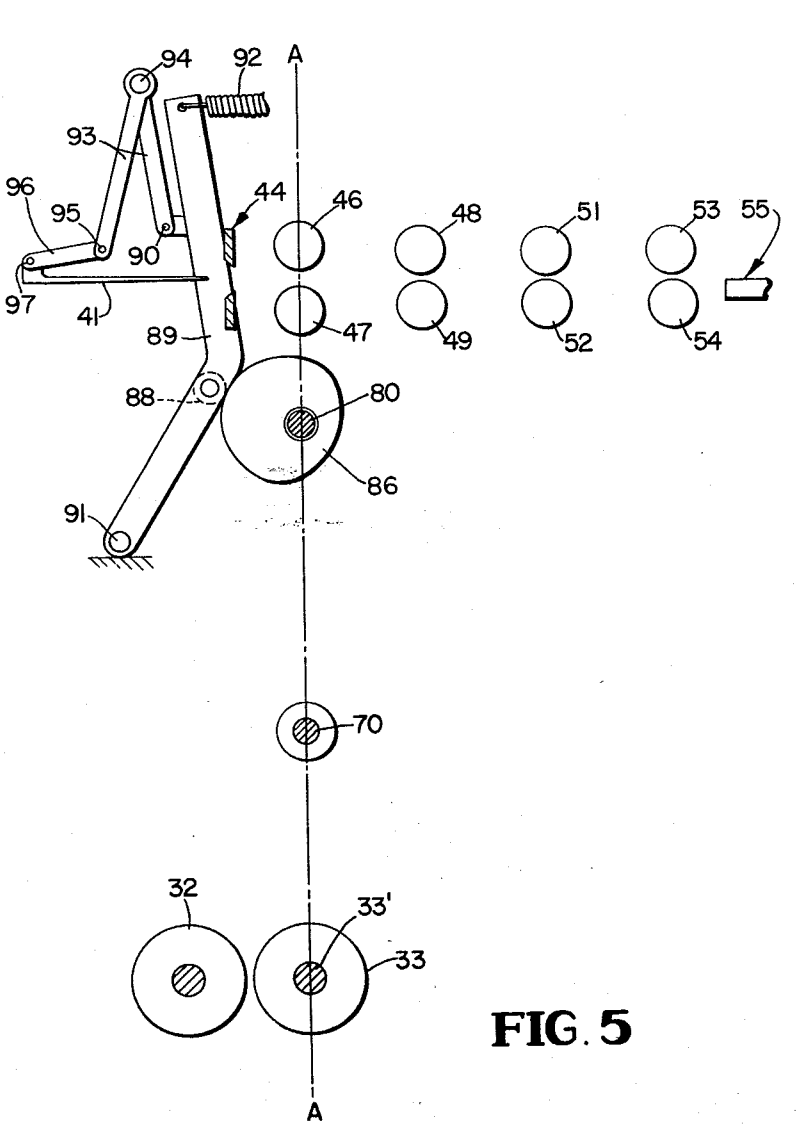
FIG. 5 is a fragmentary side elevation showing the relationship of the parts and some details of the trasverse folding mechanism.

As shown in FIG. 5, cam 86 engages a cam follower roller 88 on a lever 89 rockable about a fixed axis pivot 91 on the machine frame. A bell crank 93 pivotally connected at 90 to lever 89 is pivotally mounted on the frame at 94 and pivotally connected at 95 to one end of a link 96 pivoted at its other end at 97 to the rear end of blade 41, whereby reciprocable blade 41 is cyclically moved in one direction by cam 86 and in the other direction by spring 92. Since spring 92 moves the blade into contact with the severed towelette there is less possibility of injury to the towelette.

Figure 6:
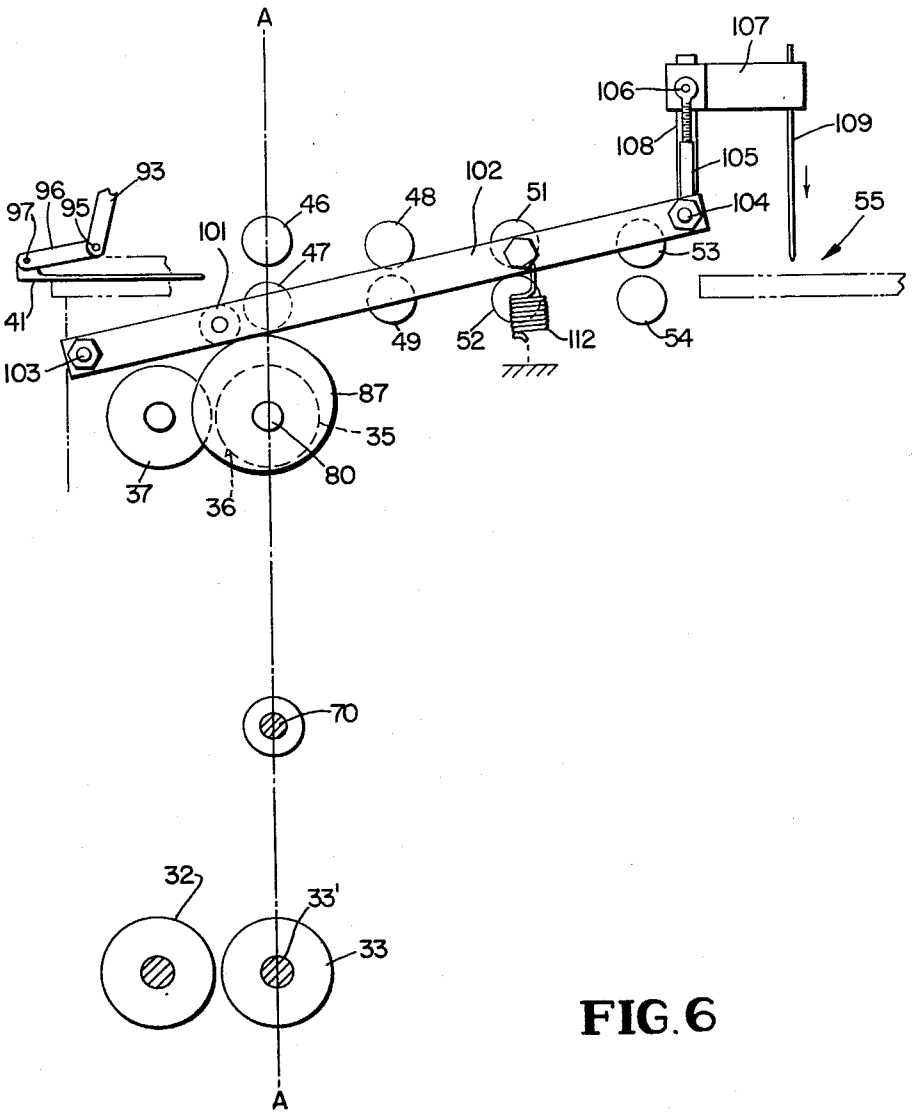
FIG. 6 is a fragmentary side elevation similar to FIG. 5 but showing further details of the transverse folding mechanism.

Referring now to FIG. 6, cam 87 on shaft 80 engages a follower roller 101 on a lever 102 pivoted at one end on the frame at 103 and at its other end at 104 to an adjustable length link 105 pivoted at one end at 106 to a crosshead 107 vertically slidably mounted in guides 108 and mounting laterally spaced vertically reciprocable second fold blades 109 and 111. A spring 112 biases lever 102 clockwise in the folding direction. Each blade 109 and 111 is connected to the crosshead by a slot and screw connection 113 (FIG. 7) permitting separate vertical adjustment of each for optimum action in second folding and thrusting towelettes.

Figure 8:
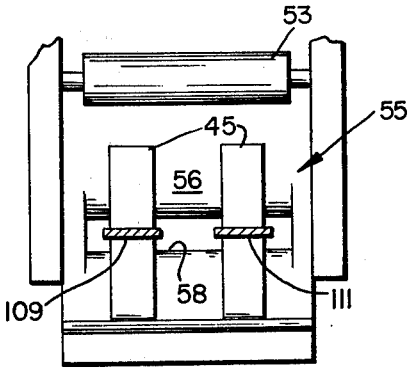
FIG. 8 is a fragmentary top plan view showing the apertured plate at the second fold station.

In operation, as the blades 109 and 111 reciprocate vertically under the influence of cam 87 and spring 112 they engage the respective first folded towelettes 45 (FIG. 8) to thrust them while folding through slot 58 into the envelopes positioned below.

The particular arrangements for automatically positioning envelopes below slot 58 in time with each reciprocation of blades 109 and 111 does not comprise part of the present invention and preferably it may comprise the arrangement disclosed in Clancy U.S. Pat. No. 3,481,099 to which reference is made for further disclosure needed to understand this feature.

Figure 9:
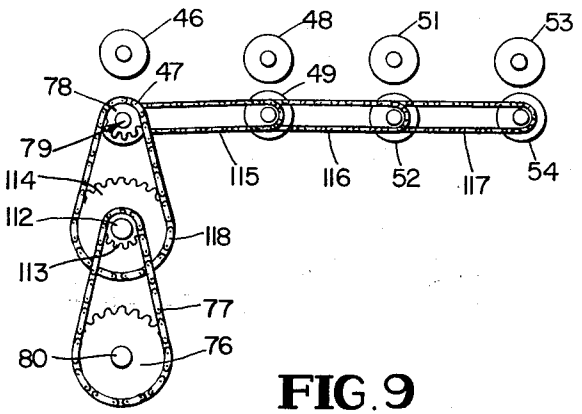
FIG. 9 is a fragmentary side elevation showing the drive to the transit rollers.

As shown in FIG. 9 a preferred form of drive transfer to the series of rollers in the transit conveyor system between the first and second transverse fold stations comprises an idler shaft 112 journalled in the frame and mounting a sprocket 113 connected by chain 77 to sprocket 76 on the knife rotor shaft.

In the embodiment shown in FIG. 9, a further larger diameter sprocket 114 on shaft 112 is connected by chain 118 to sprocket 78 on the shaft 79 of lower transit roll 47. Chain and sprocket connections indicated at 115, 116, and 117 connect the lower rollers of each pair of rollers in the transport system to be positively driven, and at the opposite side each pair of rollers 48, 49; 51, 52 and 53, 54 is geared together in the manner shown for the roller pair 46, 47 in FIG. 11. All of the sprockets in the lower rollers of each pair are of the same size, and the interconnecting gears for each pair are of the same size so that all of the transit rollers are continuously driven at the same surface speed and at a higher surface speed than feed roller 33 and knife roller 35. The ratio of speed between feed rollers 32, 33 and the transit rollers is determined by the relative diameters of sprockets 113 and 114, and these sprockets may be replaceable by different ratio pairs according to requirements.

Figure 10:
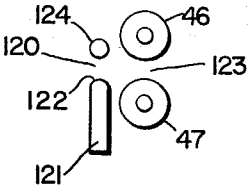
FIG. 10 is a fragmentary side view showing entry of the first folded towelette material into the transit section.

FIGS. 10 and 11 also illustrate a practical guide structure in the first transverse fold station. Viewed from the same side as in FIG. 1, the folding aperture indicated at 120 in FIG. 10 is defined along the bottom by a fixed plate 121 extending parallel to take away transit roller 47 but terminating in a rounded upper end 122 parallel to and just below the gap 123 between rollers 46 and 47. The top side of the aperture 120 is defined by a circular cross section rod 124 fixed on the frame to extend parallel to the rounded end of plate 121. The width of aperture 120 is constant and parallel to and coextensive with the space 123 between rollers 46 and 47.

FIG. 1 also illustrates a monitoring system whereby a beam of light from a source 130 passes through a bore 131 in plate 56 to a photoelectric cell unit 132 connected as at 133 to a control assembly 134 in the circuit of an electric motor driving shaft 70. Control assembly 134 may be of any configuration, but preferably it contains a relay energized to open the drive motor circuit within a fixed time whenever the photocell signals that a towelette 45 has arrived at stop 57 and has cut off the light beam. The timing of the relay is such however that if the fold blades 109, 111 descend in proper sequence to displace and thrust the towelette through slot 58, reestablishment of impingement of the light beam on the photocell will immediately deenergize the relay and there will be no interruption to the motor circuit.

The invention thus provides a compact and highly efficient automatic packaging machine wherein a continuously moving flat web is longitudinally folded at the leading end which is quickly severed into individual towelette strips that are positively double folded and thrust into envelopes with minimum waste motion. The web is moved between the longitudinal fold former and the envelope in a succession of only three straight line movements in perpendicular succession during which the transverse folding takes place. The mechanism for accomplishing this is arranged to be readily accessible for repair, cleaning, replacement or adjustment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Automatic packaging apparatus of the type wherein a continuously moving web is longitudinally folded and predetermined length strips of the longitudinally folded web are severed in succession from the leading end of said web, transversely folded and thrust into receptacles positioned in timed relation at an insertion station, characterized by longitudinal fold means disposed to receive a moving web from a supply and provide a longitudinally folded leading end on the web disposed to move upwardly in a substantially vertical path, web feed means for receiving the folded leading end of the web and continuously moving it upwardly in said path, means in said path above said feed means for severing said continuously moving leading end into successive longitudinally folded strips of predetermined length, first transverse fold means for transversely folding each said severed strip in turn, means for directly receiving each transversely folded strip and continuously advancing it along a substantially horizontal path into an insertion station, and means at said insertion station for imparting a second transverse fold to each strip in turn while thrusting it substantially vertically downwardly into a receptacle positioned at said station.

2. Apparatus as defined in claim 1, wherein said web feed means comprises a positive feed roller pass and said web severing means comprises a rotary knife station through which said leading end of the web is continuously moved, and means is provided for imparting continuous rotation to the feed rollers and synchronously actuating the rotary knife to sever the web each time the leading end portion of the web above said knife station is of said predetermined length.

3. Apparatus as defined in claim 2, wherein said rotary knife station comprises a rotary knife consisting of a knife roller mounting a longitudinally extending cutting blade and having a circumference substantially equal to said predetermined length.

4. Apparatus as defined in claim 3, wherein said rotary knife station comprises a parallel axis freely rotatable anvil roller cooperating with said knife roller.

5. Apparatus as defined in claim 2, wherein the circumference of at least one feed roller is substantially equal to a multiple of said predetermined length.

6. Apparatus as defined in claim 1, wherein means is provided for operating said web severing means and said first transverse fold means in such timed relation that as each said predetermined length is severed from the leading end of the web said first transverse fold means is actuated to substantially immediately operatively medially engage the vertically disposed severed strip and while effecting said first transverse fold thrust the strip directly and positively into operative association with said means for advancing it along the substantially horizontal path.

7. Apparatus as defined in claim 6 wherein said means for receiving and advancing said transversely folded strip comprises at least one pair of continuously driven transit rollers rotatable on substantially horizontal axes, and said first transverse fold means comprises means substantially horizontally reciprocable across said vertical path the thrust the folded strip into positive feeding relation with said rollers.

8. Apparatus as defined in claim 7, wherein said transit rollers are continuously driven at a surface speed greater than the linear speed of the leading end of said web entering the first fold station.

9. Apparatus as defined in claim 7, wherein said reciprocable first transverse fold means comprises a member having a stroke in the folding direction sufficient to positively position the folded strip between said transit rollers and said transit rollers are disposed a sufficient distance apart to avoid binding when the member is introducing the folded strip between them.

10. Apparatus as defined in claim 7, wherein said means for advancing the first folded strip along a horizontal path comprises a plurality of pairs of transit rollers between the first mentioned pair and the insertion station located to successively feed and convey the strip in maintained fold positively along said horizontal path, and all of said transit rollers are driven at substantially the same surface speed.

11. In an automatic packaging apparatus, means for longitudinally folding and continuously feeding upwardly the leading end of a continuous web, means for periodically severing said longitudinally folded leading end to provide successive upright strips of predetermined length, means synchronized with said severing means for directly engaging each upright severed strip for imparting a transverse fold thereto and thrust it into conveyor means positioned to directly receive the folded strip and positively continuously feed it substantially horizontally away from said folding means.

12. In an automatic packaging apparatus, means for longitudinally folding and continuously feeding upwardly the leading end of a continuous web, means for periodically severing said leading end to provide successive strips of predetermined length, means synchronized with said severing means for directly engaging each upright severed strip for imparting a transverse fold thereto and thrust it into conveyor means positioned to directly receive the folded strip and positively continuously feed it substantially horizontally away from said folding means, said conveyor means comprising a plurality of pairs of continuously rotated transit rollers for successively feeding said folded strip.

13. In the apparatus defined in claim 12, said fold imparting means comprising a horizontally reciprocable member having a folding stroke sufficient to positively position a folded strip between a first pair of said transit rollers, said first pair of rollers being spaced apart more than the succeeding pair or pairs to prevent binding upon entry of said member between them.

14. Apparatus of the type wherein a continuously moving web is longitudinally folded and lengths of the folded web are severed from the leading end, transversely folded and thrust into receptacles positioned in timed relation at an insertion station, characterized by web feed means for receiving the folded leading end of the web and advancing it along a path, means in said path for severing said continuously moving leading end into successive longitudinally folded strips of predetermined length comprising a knife roller mounted on a rotatable shaft, first transverse fold means for transversely folding each said strip in turn, means for transferring each first folded strip into an insertion station, means at said insertion station for imparting a second transverse fold to each strip in turn and thrusting it into a receptacle positioned at said station, and means for synchronously actuating said transverse fold means comprising means for continuously rotating said shaft and spaced cam means on said shaft operatively connected to the respective transverse fold means.

15. Apparatus as defined in claim 14, wherein said transfer means comprises a plurality of pairs of transit rollers positioned to receive and convey said first folded strip, and drive mechanism connected between said shaft and said transit rollers for continuously driving all of said transit rollers at the same surface speed.

16. Apparatus as defined in claim 14, wherein said web feed means comprises a feed roller on a rotatable shaft, and gears are provided on said feed roller and knife roller shafts meshed with a common gear on a power driven shaft.

17. Apparatus of the type wherein a continuously moving web is longitudinally folded and lengths of the folded web are severed from the leading end, transversely folded and thrust into receptacles positioned in timed relation at an insertion station, characterized by longitudinal fold means disposed to receive a moving web from a supply and provide a longitudinally folded leading end on the web, web feed means, means for severing said continuously moving leading end into successive longitudinally folded strips of predetermined length, first transverse fold means for transversely folding each said strip in turn, means for directly receiving each transversely folded strip and moving it away from said first transverse fold means and advancing it into an insertion station, means at said insertion station for imparting a second transverse fold to each strip in turn and thrusting it into a receptacle positioned at said station, and means at said station for detecting the operative presence or absence of a first folded strip.

18. A method of automatically packaging towelettes comprising the steps of longitudinally folding the leading end of a continuously upwardly moving web of towelette material, severing successive strips of predetermined length directly from said upwardly moving leading end, transversely first folding each severed strip in succession, and continuously feeding said first folded strips in succession into a second fold station at a speed greater than the speed of the longitudinally folded leading end of said web prior to severing.

19. A method of automatically packaging towelettes comprising the steps of feeding the longitudinally folded leading end of a web of towelette material in a straight line upward vertically and toward and into a first fold station, severing successive strips of predetermined length directly from said upwardly moving leading end and while each severed strip is upright imparting a horizontally directed first folding force thereto, horizontally conveying the first folded strip in a straight line away from said folding force to a second fold station, and imparting a vertically downwardly directed transverse folding force to said strip at said second fold station.

20. In the automatic packaging machine defined in claim 11, means whereby said transverse fold imparting means comprises a reciprocable member driven in such timed relation with respect to said severing means that said member engages and starts folding each severed upright strip substantially at the time the strip is severed.

* * * * *